US007000733B2

(12) United States Patent
Cunniffe

(10) Patent No.: US 7,000,733 B2
(45) Date of Patent: Feb. 21, 2006

(54) WORK PLATFORM

(75) Inventor: Nigel James Cunniffe, Frankston (AU)

(73) Assignee: Aus Struct Services Pty Ltd., (AU)

( * ) Notice: Subject to any disclaimer, the term of this patent is extended or adjusted under 35 U.S.C. 154(b) by 0 days.

(21) Appl. No.: 10/757,747

(22) Filed: Jan. 15, 2004

(65) Prior Publication Data

US 2004/0144594 A1 Jul. 29, 2004

Related U.S. Application Data

(63) Continuation-in-part of application No. PCT/AU03/00326, filed on Mar. 20, 2003.

(30) Foreign Application Priority Data

Mar. 21, 2002 (AU) ..... PS1250
Dec. 17, 2002 (AU) ..... 2002318772

(51) Int. Cl.
*E04G 1/18* (2006.01)
*E04G 3/10* (2006.01)

(52) U.S. Cl. ..... 182/142; 182/141

(58) Field of Classification Search ..... 182/45, 182/141–148, 113, 106, 129, 222, 223, 230; 248/237; 52/26, 749.12, 127.5
See application file for complete search history.

(56) References Cited

U.S. PATENT DOCUMENTS 4,689,927 A * 9/1987 Green et al. ..... 182/45
5,197,257 A * 3/1993 Nietling ..... 52/749.12
5,205,103 A * 4/1993 Burton ..... 52/749.12
5,310,018 A * 5/1994 Lahaie ..... 182/141
6,267,201 B1 * 7/2001 Cunniffe ..... 182/45
6,745,869 B1 * 6/2004 Garrett ..... 182/45

* cited by examiner

*Primary Examiner*—Hugh B. Thompson, II
(74) *Attorney, Agent, or Firm*—Traskbitt, P.C.

(57) ABSTRACT

A work platform (10) for performing work operations on an object such as roof construction work including an upper surface (15A) for working on the roof and a lower surface (15B) for storage of work material, the step between the work surfaces (15A, 15B) comprising an elongate material transfer section (19), and the upper work surface (15A) including a covered roof access section (11). The platform can also be used for access to perform maintenance work on aircraft, railway carriages, etc. The invention also provides method of performing work operations utilising the work platform (10).

9 Claims, 6 Drawing Sheets

WORK PLATFORM

RELATED APPLICATION

This application is a continuation-in-part of International Application Number PCT/AU03/00326, filed 20 Mar. 2003. This application claims foreign priority under 35 U.S.C. § 119 based on International Application Number PCT/AU03/00326, filed 20 Mar. 2003, based on Australian Patent Application No. PS1250, filed 21 Mar. 2002, and based on Australian Patent Application No. 2002318772 filed 17 Dec. 2002.

FIELD OF THE INVENTION

This invention relates to apparatus or systems and to methods for use in performing work operations on an object, such as roof construction or repair work in buildings, maintenance work on aircraft, railway carriages, ships, or other vehicles.

BACKGROUND OF THE INVENTION

The construction and more particularly the maintenance, repair or replacement of roof structures in large industrial buildings such as factory roofs presents numerous problems, particularly with ensuring the safety of workers. For example, factory roof structures sometimes need major work including replacement as a result of deterioration after years of use. Some factories produce or use corrosive substances which are present in the atmosphere in the factory and which, over periods of time, can cause severe corrosion of roof structures including the roofing materials and the support structure for the roofing materials including particularly roof purlins. Such corrosion and deterioration of roofing materials and the roof support structure can make it particularly dangerous to attempt to repair or replace the roof structure by walking on the roof. To solve this problem it has been usual in the past to erect scaffolding within the factory to enable the maintenance or replacement of the roof structure by workmen supported by the temporary scaffolding erected for the purpose. However, the erection and disassembly of such scaffolding can be time consuming and expensive and can substantially interfere with normal operations in the factory.

Although not widely and commonly known, the work platform for roof construction work disclosed in U.S. Pat. No. 6,267,201 which is equivalent to Australian patent specification AU-707069 includes an upper work surface mounted by a structural frame, the work surface having removable sections provided in a walkway extending around the perimeter of the frame enabling a worker to carry out work on the area of the roof structure below a removed section. This work platform has mounting feet and fastening means associated with the mounting feet so that the platform can be secured to the roof structure and, at the end of the required work being performed, the fastening means can be released to enable the platform to be moved to another work position on the roof structure or returned to the ground level.

The work platform in U.S. Pat. No. 6,267,201 and AU-707069 is manufactured, or at least is modified, for each particular work site. The work platform is of substantial size and mass. Therefore the construction and use of this work platform can be relatively costly. For roof construction work on smaller buildings (including industrial, commercial, and domestic buildings) or even for smaller maintenance jobs to be carried out on small or larger buildings, there is no need for such a relatively large product as disclosed in that patent, nor for the need to achieve the desired function to specially manufacture and/or modify apparatus for the purpose. Similarly the expense associated with manufacturing and/or modifying apparatus such as disclosed in that patent would not be needed or indeed desirable for smaller buildings and/or smaller jobs. Furthermore, a particular roof construction task may involve working with a building (including relatively large as well as smaller buildings) where the roof support structure on which the work platform of that patent would be mounted may not be suitable for receiving and/or supporting such a work platform.

There are other areas also where performing work operations is carried out at elevated work stations. One example is in the performance of repair, maintenance, servicing, and dismantling or disassembly work performed on vehicles, particularly aircraft, particularly large passenger aircraft where work operations need to be performed from atop the aircraft fuselage. In this situation, not only are the workers at an elevated position requiring safety measures to avoid workers falling from the work station, but also the substantial weight should not be brought to bear on the skin or panels or framework of the fuselage and the risk of damage to the aircraft by apparatus being used must be minimised. It is known to provide scaffolding-like structures which can be moved into and out of position, but these can be expensive cumbersome and bulky. It is also known to enable access to an aircraft fuselage for work operations, from overhead positions by providing gantry frames which can be moved into and out of position. These require large aircraft hanger space where the gantries are suspended from the roof structure of the hanger.

Yet further areas of application of work platforms enabling access to elevated positions or access from above work object include large vehicles other than aircraft such as railway carriages, and parts of ships whether during construction thereof or at later times for maintenance, repair or servicing purposes. In these fields, accessing elevated work sites and performing work operations at such sites can be difficult and/or dangerous and/or the structures provided to enable access can be expensive, bulky, difficult and/or time consuming to manoeuvre or to arrange in position and remove after use.

BRIEF SUMMARY OF THE INVENTION

It is an object of the present invention to provide a work platform for use in performing work operations on a work object which can enable work operations such as maintenance, repair, construction, replacement, servicing and dismantling or disassembly work to be carried out in an effective manner.

It is a further object of the present invention to provide a work platform for use in performing work operations which can be versatile in use by being useable in different work situations.

It is a further object of the present invention to provide a method of performing operations work on a work object in an effective manner by using a work platform of the invention.

It is a further object of the present invention to provide a method of performing work operations on a work object suitable for use in different work situations.

According to a first aspect of the present invention there is provided a work platform for use in performing work operations on a work object, the work operations being selected from construction, repair, maintenance, servicing and dismantling or disassembly work, the work platform including an upper work surface on which a worker can move about on the platform, and a safety barrier around at least part of the periphery of the upper work surface, the work platform further including support means for supporting the work platform in an operative position a short distance above the work object so that the worker can perform work operations on the work object below the platform, the upper work surface including at least one access section which enables access to an area of the work object below the work surface where the access section is located, the upper work surface further including at least one support section adjacent the access section so that the worker can remain on the support section of the work surface and can gain access to and can perform work operations in or on the area of the work object below the adjacent access section, the work platform further including a transfer space through or adjacent the work surface and arranged to enable materials and articles used in performing the work operations to be transferred from the work platform through the transfer space into position beneath the work platform for use in or on the work object and to enable such materials and articles removed by the worker from the work object beneath the work platform to be transferred through the transfer space and onto the work platform for storage and/or removal.

By providing the transfer space, the materials and articles (e.g. in the case of roof construction work, new roofing materials such as roof sheets and/or roofing structure supports such as purlins or, e.g. in the case of work on a vehicle, body panels, machinery, apparatus and servicing tools and equipment) can be loaded and stored on the work platform as the work platform is raised and moved into its operative position and can enable such materials and articles removed from the work object, particularly during maintenance or repair operations, to be placed and supported on the work platform during the work operations and either to be replaced or to be returned to the ground while carried by the work platform as the work platform is removed from its operative position and returned to ground level. The work platform with the transfer space can therefore be used in a variety of different situations including working with different sizes and types of building structures and in different erection, construction, maintenance, servicing or repair situations.

In one field of use, the work object may comprise a roof structure of a building and the materials and articles used in performing the work operations include roofing materials. In this field the transfer space may comprise an elongated slot through which the roofing materials including elongated members such as roof purlins and sheet materials such as roofing sheets or decking sheets can be passed. Preferably, the transfer space is dimensioned so that the worker cannot pass through the transfer space from a position atop the work surface to a position beneath the work platform from where the worker may fall from the platform or from the roof structure.

For building work, the upper work surface of the work platform preferably has two work sections consisting of a roof construction work section having the one or more access sections and a material storage section, the material storage section providing an area for roofing materials to be carried and stored thereon while the work platform is moved into its operative position preparatory to roof construction work and while the work platform is being removed from its operative position after the roof construction work has been performed. The roof construction work section of the work surface is preferably at an elevated upper level above a lower level of the material storage section of the work surface. In this construction, the transfer space preferably comprises an elongated transfer slot in the step formed between the upper level of the roof construction work section and the lower level of the material storage section, the elongated slot being arranged to enable roofing materials to be moved generally horizontally from the work surface when being transferred through the transfer slot to a position below the roof construction work section and, conversely, the roofing materials can be transferred horizontally back through the transfer slot directly onto the lower level material storage section. Preferably, at least one removable barrier is provided to inhibit or prevent roofing materials inadvertently passing through the transfer space during raising and lowering of the work platform between the ground and its operative position atop the roof structure. Such barriers may comprise for example some lengths of chain which can be hooked into position obstructing passage of roofing materials through the slot, e.g. if the work platform tilts somewhat which might otherwise cause roofing materials to slide laterally through the upright slot between the elevated work section and the lower level material storage section.

Preferably, the access section includes a safety barrier enabling a worker to insert his hands past or through the barrier to work on the work object beneath the access section but being operative to prevent a worker falling through the access section from the work platform. For example, the safety barrier (48) is formed by a mesh having relatively large openings. The mesh however is preferably not provided so as to impede the transfer of roofing materials through the transfer space and, in particular, is not provided so as to block passage of roofing materials through the transfer space. If there is safety mesh provided in the vicinity of the transfer space, either the mesh is located so as not to interfere with or impede transfer of roofing materials through the space or, alternatively, the mesh is selectively movable or removable in the vicinity of the transfer space to enable efficient transfer of roofing materials.

In another possible field of use of the work platform, the work object may comprise a roof or top surface of a vehicle. In this field, the materials and articles used in performing the work operations may be selected from vehicle components, vehicle body or top surface panels, machinery, apparatus, and servicing tools and equipment. The transfer space in this field of use may comprise an aperture through or adjacent the work surface through which the materials and articles can be passed.

As with the roof construction field, the access section may include a safety barrier enabling a worker to insert his hands past or through the barrier to work on the roof or top surface of the vehicle beneath the access section but being operative to prevent a worker falling through the access section from the work platform. The safety barrier may be formed by a mesh having relatively large openings. For vehicle work operations, the safety barrier may be selectively movable from its operative position beneath the access section (11) so as to provide a substantially clear and unobstructed open space when the work platform is located in its operative position enabling work operations to be performed on the roof or top surface of the vehicle therebeneath including passing of materials and articles through the open space. The aperture in the work surface which constitutes the transfer space may also function as the access section which enables the access to an area of the vehicle below the aperture, the support section being located adjacent to the aperture.

The access section may include at least one removable section which is temporarily removable by the worker to enable access to the area of the work object below the work surface where the removable section has been removed. The or each removable section of the work surface may be hinged to a structural frame of the work platform for upward hinging movement to thereby enable access to the area of the work object below the work surface. Alternatively, the or each removable section of the work surface may be selectively slidably mounted to a structural frame of the work platform for generally horizontal sliding movement so as to create an opening enabling access to the area of the work object below the work surface.

In an alternative embodiment to the one providing removable sections, the or each support section of the upper work surface may comprise a foot support surface adjacent to an access section and on which the worker can place his foot or feet so as to be supported while working on the work object through the access section and while standing or moving about on the work platform. The or each foot support surface may be permanently mounted as part of the structure of the work platform. The or each foot support surface may comprise a foot plate or an elongated tread surface.

The present invention in a second aspect provides a method of performing work operations on a work object, the method including the steps of providing a work platform according to the first aspect of the invention, lifting the work platform into an operative position on top of the work object, supporting and maintaining the work platform in the operative position so that a worker can perform work on the work object below the work platform, performing work operations on the work structure from a position atop the work surface by accessing the work object through the access section, and transferring materials and articles between said work platform and the work object by passing the materials and articles through the transfer space through or adjacent the work surface.

In the preferred method the support means provided for supporting the work platform in its operative position a short distance above the work object includes stabilising means operative to restrain the work platform against substantial movement during the performance of work on the work object by the worker.

In the field of roof construction work, wherein the work object comprises a roof structure of a building and wherein the materials and articles used in performing the work operations include roofing materials, the stabilising means preferably includes restraining means for co-operating with the roof structure to restrain the work platform against substantial movement, the restraining means including anchoring means which is releasably coupled to the roof structure.

In one possible method the work platform is suspended by suspension means in its operative position so that at least part of the weight of the work platform, roofing materials carried thereby, working tools, and worker carried thereby is not totally transferred to and supported by the roof structure, and wherein the stabilising means includes releasable arms, guys, or struts which extend between the work platform and the roof structure and which anchor to the roof structure so as to restrain the work platform against substantial movement when it is held suspended in its operative position a short distance above the roof structure. In this case, the suspension means, which may comprise suspension cables, chains, or the like, may be attached at attachment points provided by the work platform so that the work platform in use is suspended by means of the suspension cables or the like a short distance above the roof structure. A crane, for example, may be used for suspending the work platform in its operative position, as well as for raising the work platform from the ground to its operative position and for returning the work platform from the roof structure back to the ground.

In a further possible method, the work platform may include means for engaging with the roof structure so that at least part of the weight of the work platform, roofing materials carried thereby, working tools, and worker carried thereby is transferred to the roof structure when the work platform is in its operative position. In this further method the means for engaging with the roof structure may include feet which engage with the roof structure, the restraining means including releasable fasteners or attachments for attaching the feet of the work platform to the roof structure. It will also be appreciated that if the work platform is brought into its operative position resting on the roof structure, not all of the weight thereof need be transferred to the roof structure and, in particular, the suspension means can continue to be employed to carry some of the weight so that only a portion of the weight is transferred to the roof structure.

In a method using a platform with removable sections, the roof construction work is performed on the roof structure from a position atop the upper work surface by first removing the removable section to permit the worker positioned on the upper work surface to access the roof structure through the opening created upon removal of the removable section.

The roofing materials which are carried on the platform, and on the material storage section in particular, can be new materials loaded onto the material storage section with the work platform resting on the ground, after which the work platform is lifted by crane into its operative position and the roofing materials can be transferred through the transfer space for installing the new roofing materials in the roof structure. Likewise, the roofing materials removed from the roof structure, e.g. during maintenance or repair operations, can be passed through the transfer space and stored on the material storage section and then returned to ground level with the work platform.

The provision of the safety barrier around at least part of the periphery of the work surface, and preferably entirely around the work platform, together with the overall constructional features of the work platform, enable the worker to ride on the platform as it is lifted from the ground into its operative position and vice versa. This can be particularly advantageous for relatively small roofing maintenance, repair or other construction tasks.

When the work platform is used for accessing the roof or top surface of a vehicle, the work platform preferably further includes cushion means located beneath the work platform. The method of use therefore includes the step of positioning the work platform so that the cushion means engages against the roof or top surface of the vehicle and provides a cushioning between the work platform and the roof or top surface of the vehicle but without all of the weight of the work platform bearing on the roof or top surface of the vehicle through the cushion means. The cushion means may comprise at least one flexible and gas filled cushioning compartment or bag located beneath the work platform so as to be interposed between the work platform and the roof or top surface of the vehicle. For uses in which the vehicle comprises an aircraft fuselage having a longitudinal dimension extending in the direction from nose to tail of the aircraft, the cushion means of the work platform preferably comprises at least two elongated gas filled cushions extending in the longitudinal direction of the fuselage so as to bear against the upper surface of the fuselage along laterally spaced lines when the work platform is located in its operative position for enabling performance of the work operations.

The preferred construction of work platform includes lifting apparatus for supporting, raising and lowering materials and articles from positions generally above the transfer space. In use of this construction the work platform can be suspended by suspension means in its operative position so that at least part of the weight of the work platform and any load carried thereby is not transferred to and supported by the work object, the lifting apparatus being mounted by the suspension means whereby the weight of materials and articles being supported by the lifting apparatus is predominantly carried by the suspension means and is not substantially transferred to the work platform and thence to the work object.

BRIEF DESCRIPTION OF THE DRAWINGS

Possible and preferred features of the present invention will now be described with particular reference to the accompanying drawings. However it is to be understood that the features illustrated in and described with reference to the drawings are not to be construed as limiting on the scope of the invention. In the drawings.

DETAILED DESCRIPTION

Figure 1:
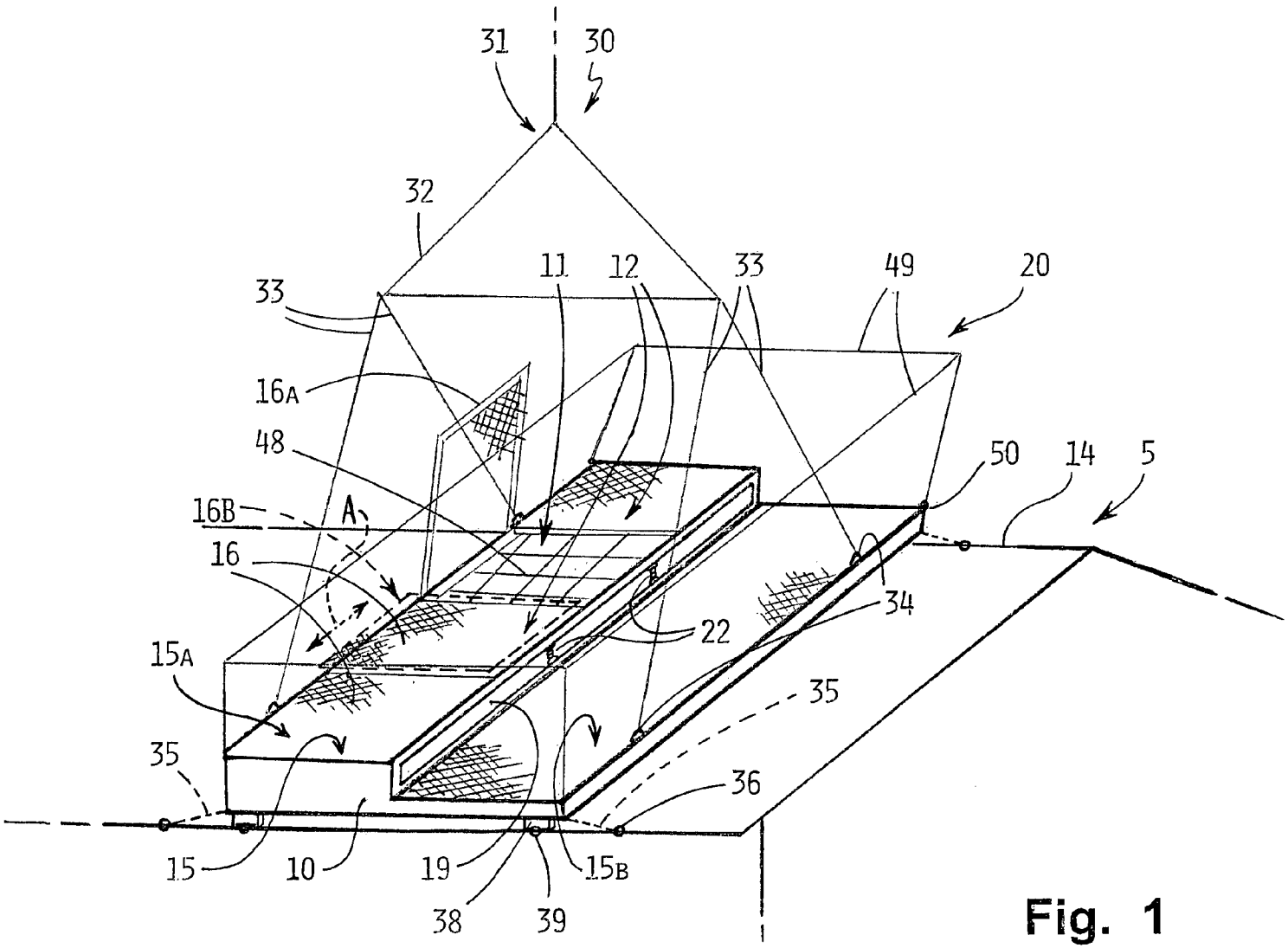
FIG. 1 is a schematic perspective view of a work platform according to an embodiment of the present invention in use in building construction work.
Figure 2:
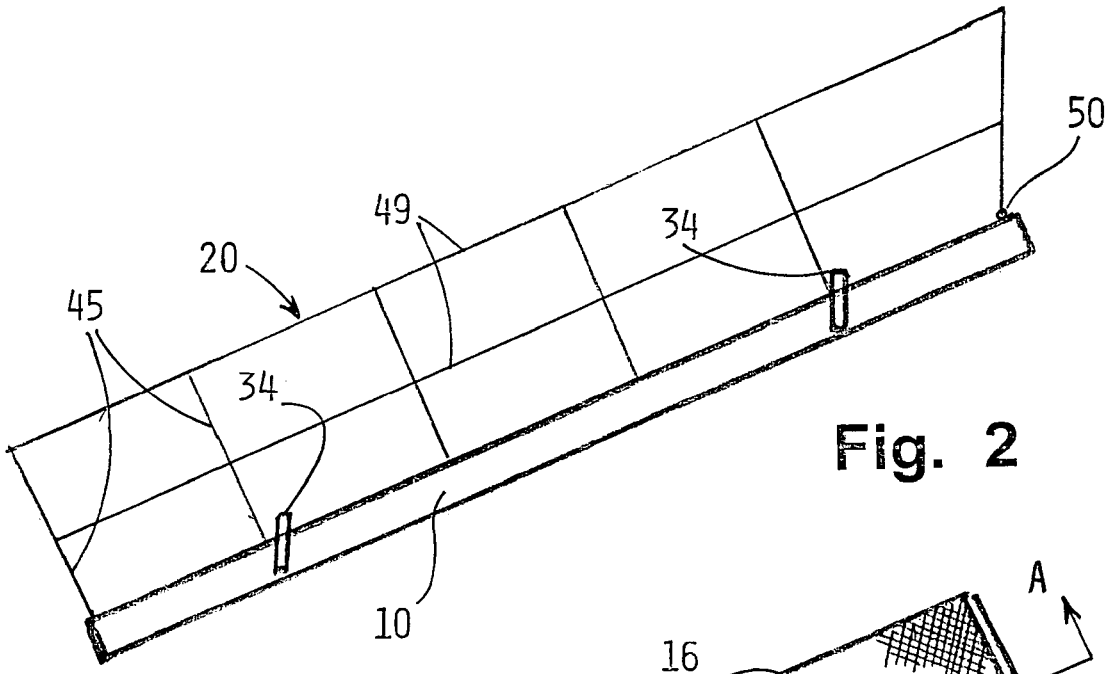
FIG. 2 is a side view of the work platform of FIG. 1.
Figure 3:
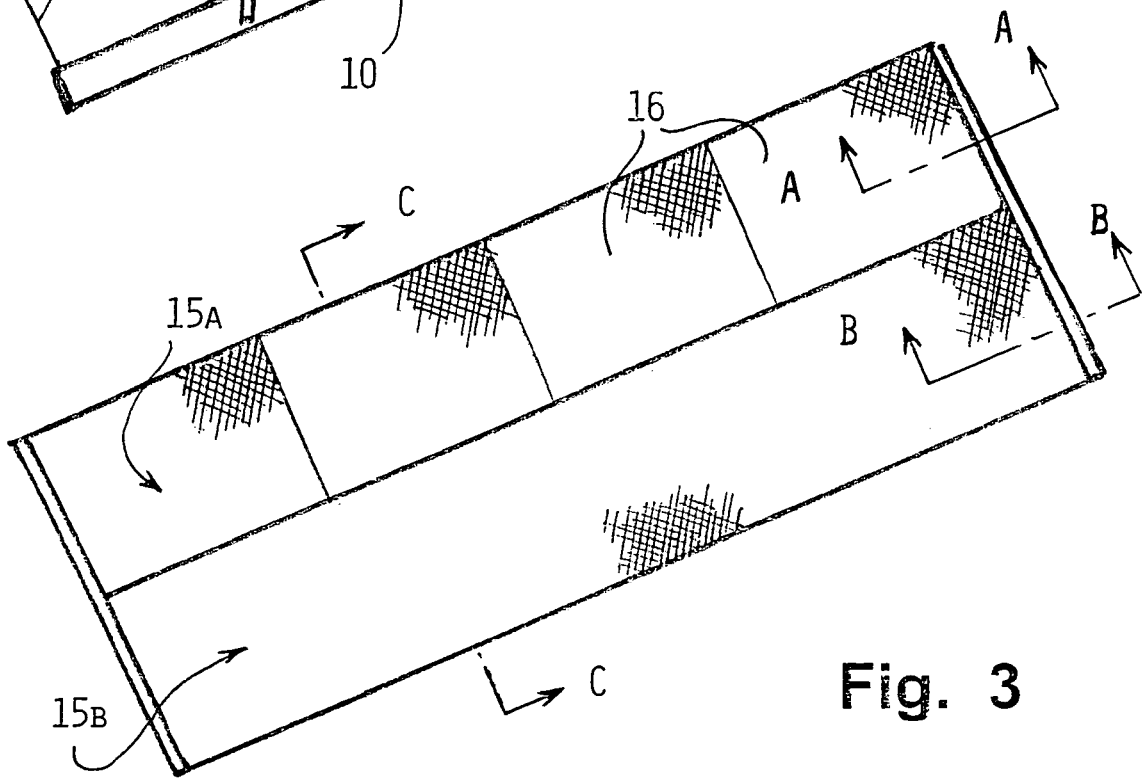
FIG. 3 is a plan view of the work surface of the work platform of FIG. 1.
Figure 4:
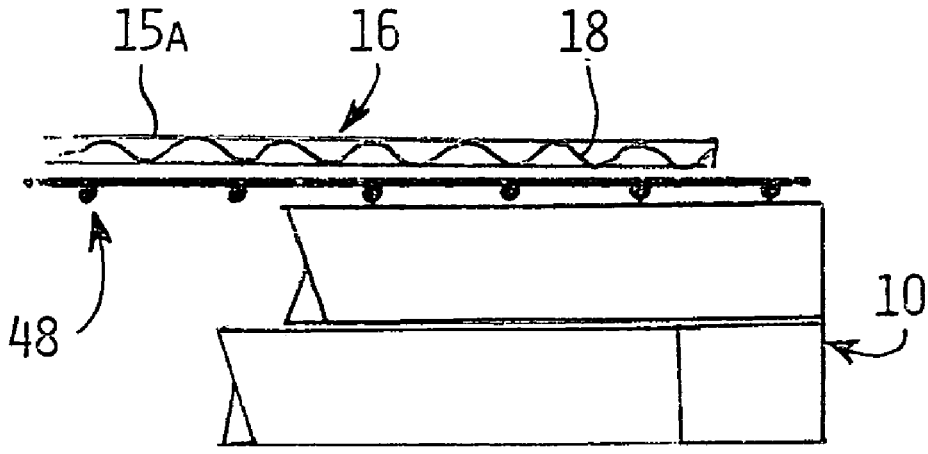
FIG. 4 is a sectional view along the line A—A of FIG. 3.
Figure 5:
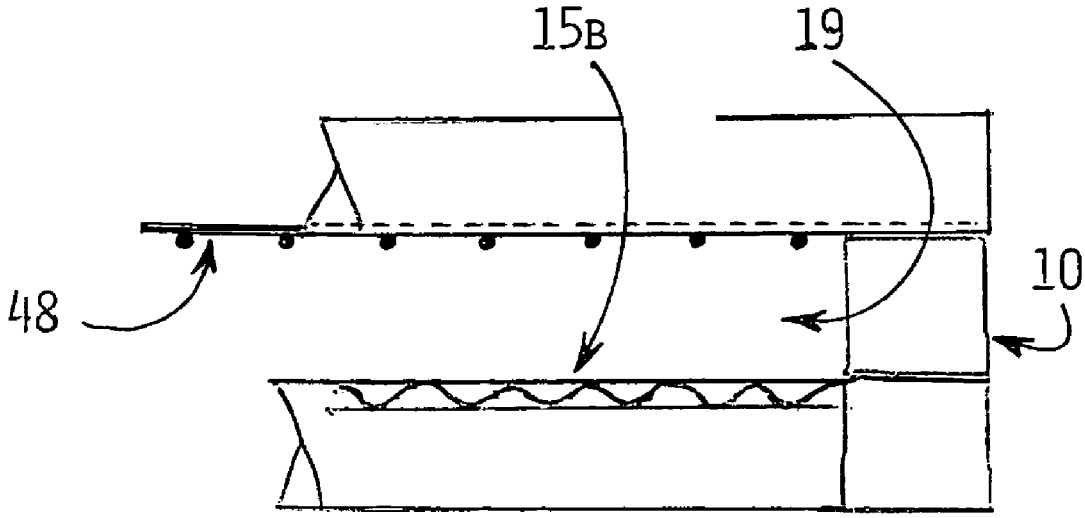
FIG. 5 is a sectional view along the line B—B of FIG. 3.
Figure 6:
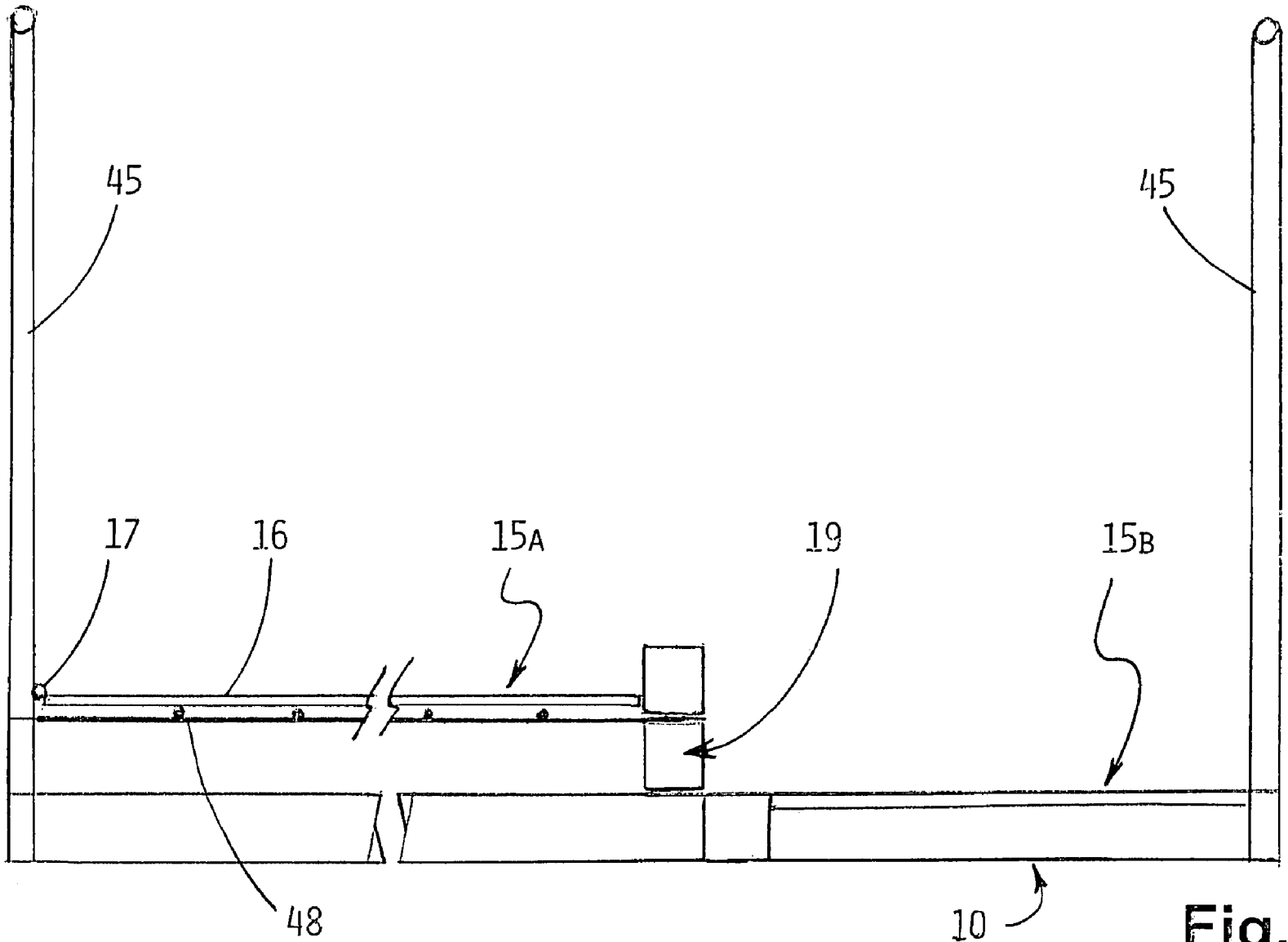
FIG. 6 is a sectional view along the line C—C of FIG. 3.

Referring to the drawings, the work platform comprises a frame 10 made of any suitable material such as metal sections bolted or otherwise fastened together so as to provide a rigid structural mounting for other parts. For roof construction work, the length of the platform may be generally about the length of the rafters of the roof structure 5 so that when the platform is in its operative position as shown in FIG. 1, a worker by moving around on the platform can have access to the roof structure along a long side of the platform, to the ridge 14 of the building along the upper short side, and to the outer lower edge of the roof structure along the opposite short side of the platform. However, dimensions are not critical and indeed the platform can be useable with different sizes and types of buildings and roofs, and, as described later with other work environments such as aircraft maintenance.

On the frame 10 there is an upper work surface 15 mounted by the frame 10 and on which the worker can move about on the platform. The upper work surface can be made of any suitable construction and materials and in the illustrated embodiments comprises a grid material suitable for supporting the weight of the person and weight of building materials. In FIGS. 1 to 7, the upper work surface has two sections, a roof construction work section 15*a* and, at a slightly stepped down lower level, a material storage section 15*b*. The material storage section 15*b* can be of continuous mesh construction having a fixed floor and is provided for carrying and supporting roofing materials. The elevated work section 15*a* provides at least one access section 11 enabling worker access to work on the roof structure beneath the platform. Adjacent the access section 11 is at least one support section 12 of the work surface 15 so that a worker can be supported on the support section 12 while accessing and working on the roof structure 5 through the access section 11. In FIG. 1, the access through the support section 12 is enabled by providing a surface made of multiple sections, such as panels 16 which have peripheral frames to which the grid material 18 on which the worker walks is mounted (see FIG. 4). Each panel 16 can be mounted to the frame 10 of the platform by hinges 17 so that each work surface section or panel 16 can be independently removable by hinging upwardly (as shown at 16*a* in FIG. 1) to enable access to the area below the removed section. Below the movable sections 16 of the work surface there is provided a relatively open safety mesh 48 having relatively large openings sufficient to enable the worker to carry out operations beneath the mesh but being sufficiently small to prevent a worker falling through.

Instead of the pivoted or hinged removable panels 16*a* as shown in FIG. 1, removable panels 16*b* may be selectively slidably mounted to the structural frame 10 of the work platform, e.g. in parallel spaced tracks, for generally horizontal sliding movement as shown by arrow A above or below an immediately adjacent panel so as to create an opening 11 enabling access to the area of the roof structure below the work surface.

In the step formed between the elevated work section 15*a* and the lower material storage section 15*b* there is an upright transfer space 19 in the form of an open slot through which roofing material such as roofing sheets, structural supports, etc can be transferred from the lower level storage section 15*b* into position beneath the elevated work section 15*a* and, vice versa. The transfer space 19 is sufficiently small in height to prevent a person fitting through the space but is elongated to enable roofing sheets, purlins, etc to pass therethrough by transverse movement. Removable barriers 22, such as chains, prevent roofing materials sliding laterally through the space 19 during raising and lowering of the platform to and from the roof structure.

A safety barrier 20 is provided around the platform. The safety barrier is comprised by upright posts 45 mounted to the frame 10 and multiple safety rails or lines 49 extending between adjacent posts.

The safety barrier 20 at the upper end of the platform can be mounted at point 50 to the frame 10 for hinging movement outwardly. The purpose of enabling outward hinging movement to a limited extent is to enable more easy access to the ridge 14 of the roof structure when the platform is mounted in position on an inclined roof structure as shown in FIG. 1.

A support means 30 supports the work platform in its operative position a short distance above the roof structure 5. The support means 30 includes suspension means 31 having suspension cables 32, 33. The cables 33 are fixed at attachment points 34 provided on the frame 10. A crane (not shown) lifts the platform from the ground to the operative position shown in FIG. 1 and carries the weight of the platform and the materials, tools, and worker(s) both during raising and lowering of the platform to and from its operative position and during maintenance of the platform in its operative position during the performance of work on the roof structure. To stabilise the platform in its operative position, restraining means such as the anchoring arms, guys or struts 35 co-operate with the building or roof structure (or possibly with points at ground level) to restrain the work platform against substantial movement. These stabilising means 35 can be installed in position by releasable anchoring means 36 and released by the worker at the start of and at the end of the work operation.

Some of the weight of the platform and its load can be transferred to the building structure by engaging feet 38 which can be releasably fastened or attached at 39 to the roof structure.

Figure 7:
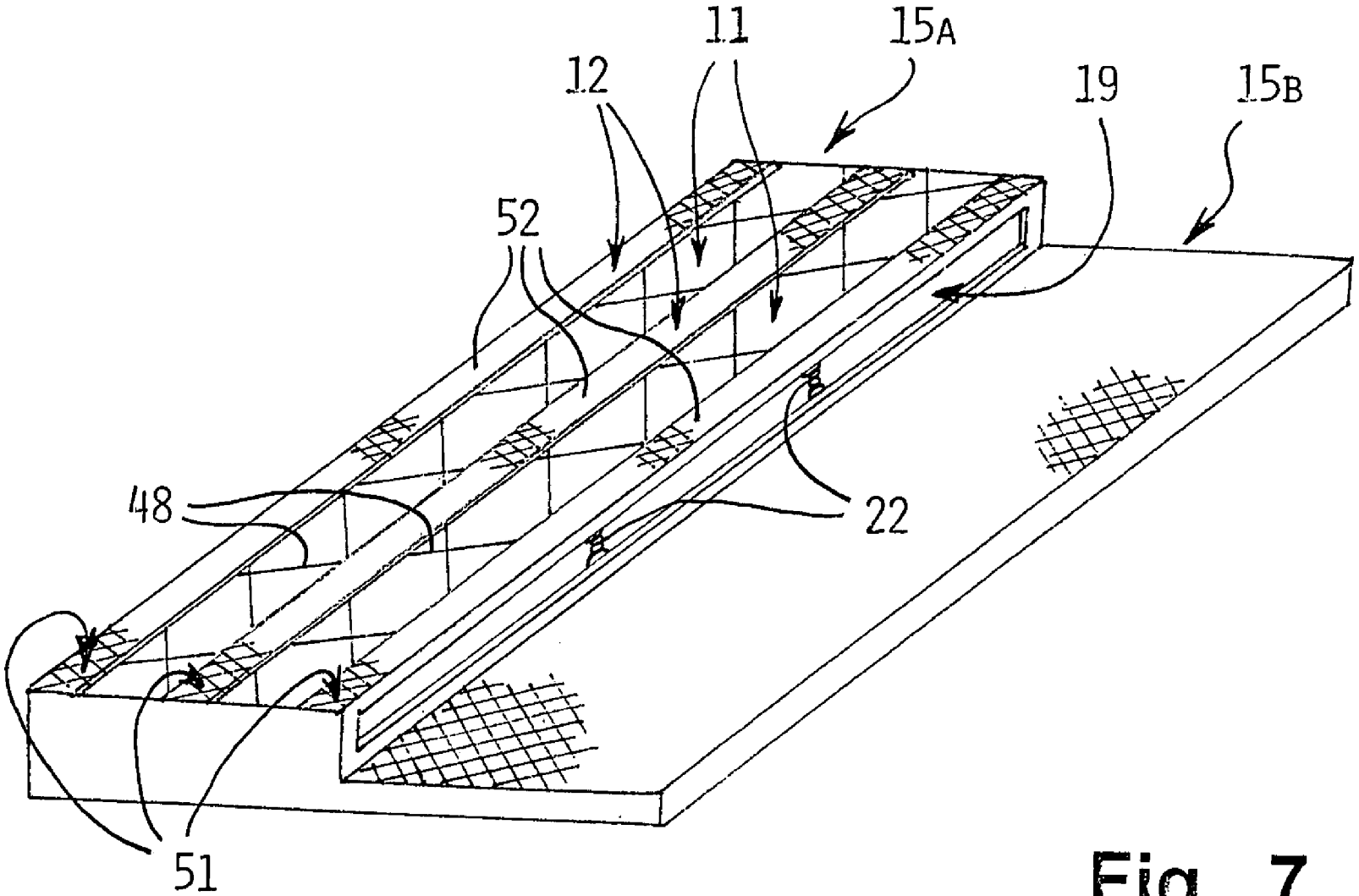
FIG. 7 is a schematic perspective view of the work surface of an alternative configuration of work platform for roof construction work according to a further embodiment of the present invention.

In the embodiment of FIG. 7, the access space 11 provided by the upper roof construction work section 15*a* is provided by one or more spaces, provided with mesh 48 to prevent a worker falling through, adjacent foot support surfaces on which a worker can place his foot or feet so as to be supported while working on the roof structure through the access section 11 and while standing or moving about on the work platform. Each foot support surface 51 is securely and preferably permanently mounted as part of the structure of the work platform. As illustrated, each foot support surface can comprise a foot plate or, as illustrated, an elongated tread surface 52. In this embodiment of FIG. 7, there is no need for the provision of removable sections such as the hinged panels 16*a* or sliding panel 16*b* of FIG. 1.

When the work platform of either embodiment illustrated in FIG. 1 or FIG. 7 of the drawings is in its operative position on a roof structure with the support means and stabilising means maintaining the platform in its position, it is possible for worker(s) on the platform to carry out erection, maintenance, repair and replacement work on the roof structure. For example, to remove and replace corroded or otherwise structurally unsound roofing sheets or purlins, the worker can move around work section of the platform unfastening the roofing materials and passing them through the transfer space onto the storage section. When the roofing materials have be unfastened and placed on the storage section, the entire platform can be released and the platform with the roofing materials therein can be lifted and lowered to the ground by crane. After removal of the old materials, new materials can be loaded onto the storage section and the platform lifted and relocated in its operative position. The worker can pass the new materials through the transfer space and secure the new materials to the roof structure.

Figure 8:
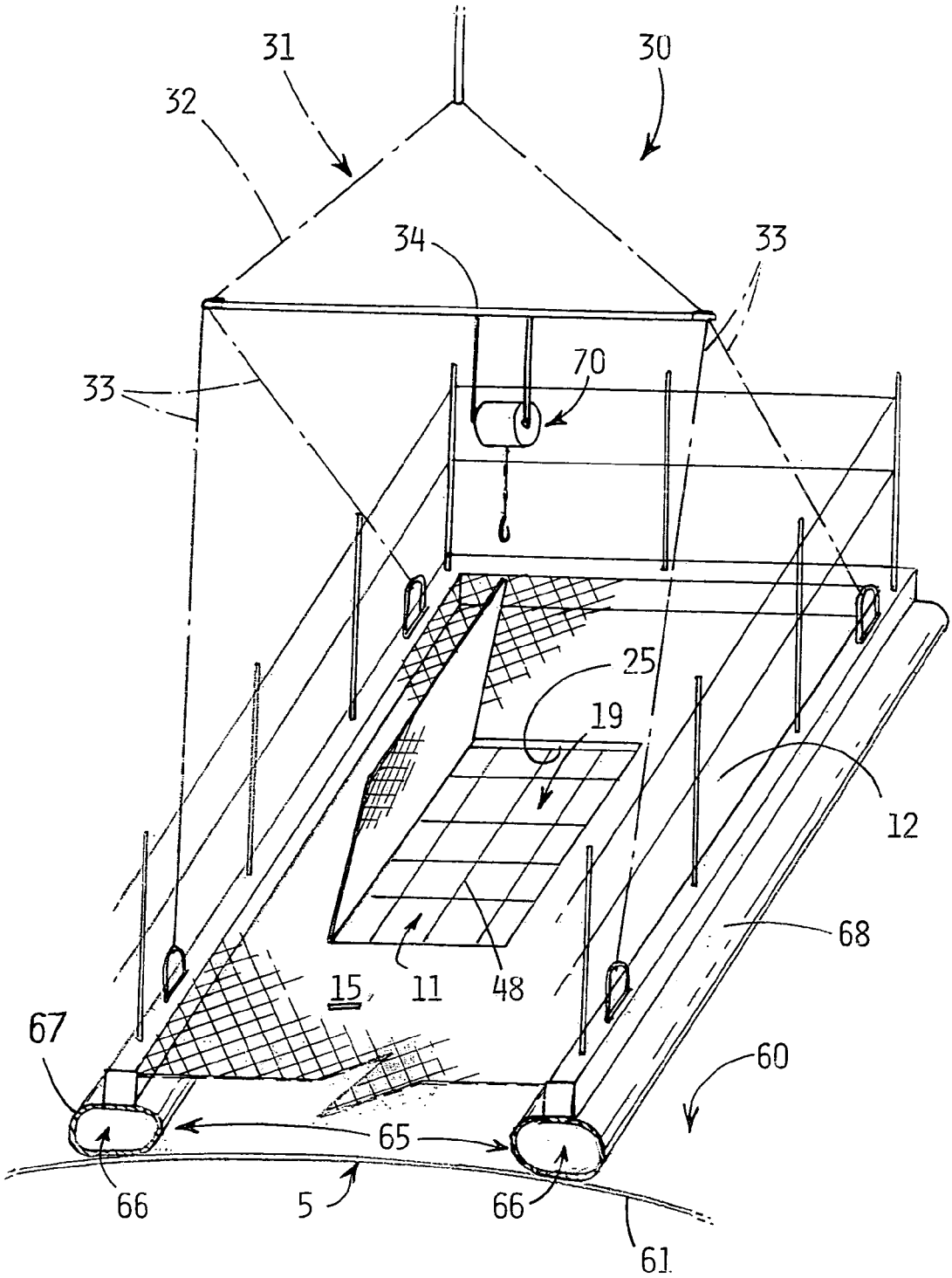
FIG. 8 is a schematic, part sectional, perspective view of a further embodiment of the work platform for use in work on a vehicle.

The embodiment in FIG. 8 of the drawings is intended for use in environments where the work object 5 comprises a roof or top surface of a vehicle 60. The vehicle may for example be an aircraft and the roof or top surface is at the top of the fuselage, or may be a railway vehicle or carriage, or may be a deck or hatch or other structure of a ship (whether under construction or undergoing maintenance, repair, servicing, etc). In this field of use, the materials and articles used in performing the work operations can be selected from vehicle components, vehicle body or top surface panels, machinery, apparatus, and servicing tools and equipment.

In FIG. 8, the transfer space comprises an aperture 25 through the work surface 15 and through which the materials and articles can be passed. The aperture 25 in the work surface 15 which constitutes the transfer space 19 also functions as the access section 11 which enables the access to the area of the vehicle 60 below the aperture 25. The support section 12 is located adjacent the aperture 25.

As in the earlier embodiments, the access section 11 includes a safety barrier 48 formed by mesh having relatively large openings and enabling a worker to insert his hands past or through the barrier to work on the roof or top surface of the vehicle 60 beneath the access section 11. The barrier 48 is operative to prevent a worker falling through the access section 11 from the work platform. The safety barrier 48 is selectively movable from its operative position shown in FIG. 8 beneath the access section 11, e.g. by being lifted, hinged, or slid away from the illustrated position, so as to provide a substantially clear and unobstructed open space when the work platform is located in its operative position for the performance of work operations on the roof or top surface of the vehicle 60 including passing of materials and articles through the open space. For example, panels or components or equipment of an aircraft can be moved through the open space during the work operations.

In the embodiment of FIG. 8, the work platform includes cushion means 65 located beneath the work platform. The cushion means 65 engages against the roof or top surface of the vehicle 60 and provides a cushioning between the work platform and the roof or top surface but without all of the weight of the work platform bearing on the roof or top surface of the vehicle through the cushion means. The cushion means 65 comprises flexible and gas filled cushioning compartments or bags 66 located beneath the work platform so as to be interposed between the work platform and the roof or top surface of the vehicle 60.

In the embodiment wherein the vehicle 60 comprises an aircraft fuselage 61 having a longitudinal dimension extending in the direction from nose to tail of the aircraft, the cushioning means 65 comprises two elongated gas filled cushions 67, 68 extending in the longitudinal direction of the fuselage so as to bear against the upper surface of the fuselage along laterally spaced lines when the work platform is located in its operative position.

The support means 30 in FIG. 8 is generally similar in construction and operation to the other embodiments and, in particular, includes suspension means 31 for suspending the work platform in its operative position so that at least part of the weight of the work platform and any load carried thereby is not transferred to and supported by the work object 5. The suspension means 31 includes a cross beam 34. A lifting apparatus 70 such as a winch is provided for supporting, raising and lowering materials and articles from positions generally above the transfer space 19 defined by the aperture 25. The lifting apparatus 70 is mounted by the suspension means 31, in particular by the cross beam 34 in the illustrated embodiment, so that the weight of materials and articles being supported by the lifting apparatus 70 is predominantly carried by the suspension means 31 and is not substantially transferred to the work platform and thence to the work object 5.

It will be understood from the preceding description in conjunction with the possible embodiments illustrated in the drawings, that variations and modifications of the platform and its use are feasible. For example the upper level of the work surface in the illustrated embodiment of FIGS. 1 and 7 comprises the work section and the lower level comprises the material storage section, however the reverse is equally feasible. Likewise, the split level work surface is not essential and also the transfer space could be provided at other locations. For example, the transfer space could be provided along an edge of the work platform so that materials and articles can be transferred through the transfer space to a position adjacent or at least overlapping with the edge of the platform before being used in the work operations. The work operations do not need to be entirely carried out directly below the work surface, but at least some of the work operations can be carried out outside the perimeter of the work platform. The entire area of the work surface can be provided with removable sections.

Various other constructional features of a work platform according to the invention can be provided as alternatives or as additional components of the work platform particularly described and illustrated herein. In particular, the entire contents of patent specification U.S. Pat. No. 6,267,201 and AU-707069 are incorporated herein in full by cross-reference so as to provide examples and details of constructional and operational features of a work platform that can possibly be incorporated in the platform of the present invention. Examples of such alternative or additional features include: details of the construction and operation of the hinged platforms of the work surface, details of the mesh provided beneath the hinged panels, the construction, configuration and operation of the safety barrier around the periphery, and the construction and operation of the mounting feet and associated fastening means (if provided) are all described in U.S. Pat. No. 6,267,201 and AU-707069 in more detail and can be incorporated in the platform of the present invention.

It will be understood from the preceding description and accompanying drawings that the present invention provides an effective solution (both apparatus and method) to problems of safely and readily enabling work on a roof structure. Such work can include erection as well as maintenance, repair and replacement of the roof structure. The work platform is versatile and is useable with different types and sizes of buildings and does not require to be constructed or modified for different uses. It can be used with small buildings and for small roof maintenance tasks.

In the use of the work platform where the work object comprises an aircraft, th use of the platform enables elimination of the need for an access scaffold to enable access to the work site. The set up time for providing access to the work site is minimised and the aircraft for example can be located on tarmac or elsewhere at the terminal, i.e. there is no need for the aircraft to be located inside a hanger where gantries or special access scaffolding is available. This also can lead to increases in productivity.

It is to be understood that various alterations, modifications and/or additions may be made to the features of the possible and preferred embodiment(s) of the invention as herein described without departing from the scope of the invention.

What is claimed is:

1. A work platform for use in performing work operations on a roof structure of a building, the work operations being selected from construction, repair, maintenance, servicing and dismantling or disassembly work, the work platform including an upper work surface on which a worker can move about on the platform, and a safety barrier around at least part of the periphery of the upper work surface, the work platform further including support means for supporting the work platform in an operative position a short distance above the roof structure so that the worker can perform work operations on the roof structure below the platform, the upper work surface including at least one access section which enables access to an area of the roof structure below the work surface where the access section is located, the upper work surface further including at least one support section adjacent the access section so that the worker can remain on the support section of the work surface and can gain access to and can perform work operations in or on the area of the roof structure below the adjacent access section, the work platform further including a transfer space through or adjacent the work surface and arranged to enable materials and articles used in performing the work operations to be transferred from the work platform through the transfer space into position beneath the work platform for use in or on the roof structure and to enable such materials and articles removed by the worker from the roof structure beneath the work platform to be transferred through the transfer space and onto the work platform for storage or removal, the materials and articles used in performing the work operations include roofing materials, the transfer space comprising an elongated slot through which the roofing materials including elongated members such as roof purlins and sheet materials such as roofing sheets or decking sheets can be passed, wherein the upper work surface of the work platform has two work sections consisting of a roof construction work section having the one or more access sections and a material storage section, wherein the roof construction work section of the work surface is at an elevated upper level above a lower level of the material storage section of the work surface, the material storage section providing an area for roofing materials to be carried and stored thereon while the work platform is moved into its operative position preparatory to roof construction work and while the work platform is being removed from its operative position after the roof construction work has been performed.

2. A work platform as claimed in claim 1 wherein the transfer space is dimensioned so that the worker cannot pass through the transfer space from a position atop the work surface to a position beneath the work platform from where the worker may fall from the platform or from the roof structure.

3. A work platform as claimed in claim 1 wherein the transfer space comprises an elongated transfer slot in the step formed between the upper level of the roof construction work section and the lower level of the material storage section, the elongated slot being arranged to enable roofing materials to be moved generally horizontally from the work surface when being transferred through the transfer slot to a position below the roof construction work section and, conversely, the roofing materials can be transferred horizontally back through the transfer slot directly onto the lower level material storage section.

4. A work platform as claimed in claim 1 wherein at least one removable barrier is provided to inhibit or prevent roofing materials inadvertently passing through the transfer space during raising and lowering of the work platform between the ground and its operative position atop the roof structure.

5. A work platform for use in performing work operations on a work object, the work operations being selected from construction, repair, maintenance, servicing and dismantling or disassembly work, the work platform including an upper work surface on which a worker can move about on the platform, and a safety barrier around at least part of the periphery of the upper work surface, the work platform further including support means for supporting the work platform in an operative position a short distance above the work object so that the worker can perform work operations on the work object below the platform, the upper work surface including at least one access section which enables access to an area of the work object below the work surface where the access section is located, the access section including at least one removable section which is temporarily removable by the worker to enable access to the area of the work object below the work surface where the removable section has been removed, the upper work surface further including at least one support section adjacent the access section so that the worker can remain on the support section of the work surface and can gain access to and can perform work operations in or on the area of the work object below the adjacent access section, the work platform further including a transfer space through or adjacent the work surface and arranged to enable materials and articles used in performing the work operations to be transferred from the work platform through the transfer space into position beneath the work platform for use in or on the work object and to enable such materials and articles removed by the worker from the work object beneath the work platform to be transferred through the transfer space and onto the work platform for storage or removal, wherein said at least one removable section of the work surface is selectively slidably mounted to a structural frame of the work platform for generally horizontal sliding movement so as to create an opening enabling access to the area of the work object below the work surface.

6. A method of performing work operations on a roof structure of a building, the method including the steps of:

providing a work platform for use in performing work operations on a roof structure of a building, the work operations being selected from construction, repair, maintenance, servicing and dismantling or disassembly work, the work platform including an upper work surface on which a worker can move about on the platform, and a safety barrier around at least part of the periphery of the upper work surface, the work platform further including support means for supporting the work platform in an operative position a short distance above the roof structure so that the worker can perform work operations on the roof structure below the platform, the upper work surface including at least one access section which enables access to an area of the roof structure below the work surface where the access section is located, the upper work surface further including at least one support section adjacent the access section so that the worker can remain on the support section of the work surface and can gain access to and can perform work operations in or on the area of the roof structure below the adjacent access section, the work platform further including a transfer space through or adjacent the work surface and arranged to enable materials and articles used in performing the work operations to be transferred from the work platform through the transfer space into position beneath the work platform for use in or on the roof structure and to enable such materials and articles removed by the worker from the roof structure beneath the work platform to be transferred through the transfer space and onto the work platform for storage or removal, lifting the work platform into an operative position on top of the roof structure, the work platform in its operative position being located a short distance above the roof structure, supporting and maintaining the work platform in the operative position so that a worker can perform work on the roof structure below the work platform, the step of maintaining the work platform in the operative position including providing stabilising means operative to restrain the work platform against substantial movement during the performance of work on the roof structure by the worker, the stabilising means including restraining means for co-operating with the roof structure to restrain the work platform against substantial movement, the restraining means including anchoring means which is releasably coupled to the roof structure, performing work operations on the roof structure from a position atop the work surface by accessing the roof structure through the access section, and transferring materials and articles including roofing materials between said work platform and the roof structure by passing the materials and articles through the transfer space through or adjacent the work surface, wherein the work platform is suspended by suspension means in its operative position so that at least part of the weight of the work platform, roofing materials carried thereby, working tools, and worker carried thereby is not totally transferred to and supported by the roof structure, and wherein the stabilising means includes releasable arms, guys, or struts which extend between the work platform and the roof structure and which anchor to the roof structure so as to restrain the work platform against substantial movement when it is held suspended in its operative position a short distance above the roof structure.

7. A method of performing work operations on a roof or top surface of a vehicle, the method including the steps of providing a work platform from which the work operations are performed, the work operations being selected from construction, repair, maintenance, servicing and dismantling or disassembly work performed on or at the roof or top surface of the vehicle, the work platform including an upper work surface on which a worker can move about on the platform, and a safety barrier around at least part of the periphery of the upper work surface, the work platform further including support means for supporting the work platform in an operative position a short distance above the roof or top surface of the vehicle so that the worker can perform work operations on the roof or top surface of the vehicle below the platform, the upper work surface including at least one access section which enables access to an area of the roof or top surface of the vehicle below the work surface where the access section is located, the upper work surface further including at least one support section adjacent the access section so that the worker can remain on the support section of the work surface and can gain access to and can perform work operations in or on the area of the roof or top surface of the vehicle below the adjacent access section, the work platform further including a transfer space through or adjacent the work surface and arranged to enable materials and articles used in performing the work operations to be transferred from the work platform through the transfer space into position beneath the work platform for use in or on the roof or top surface of the vehicle and to enable such materials and articles removed by the worker from the roof or top surface of the vehicle beneath the work platform to be transferred through the transfer space and onto the work platform for storage or removal, the materials and articles used in performing the work operations being selected from vehicle components, vehicle body or top surface panels, machinery, apparatus, and servicing tools and equipment, the transfer space comprising an aperture through or adjacent the work surface through which the materials and articles can be passed, lifting the work platform into an operative position on top of the roof or top surface of the vehicle, supporting and maintaining the work platform in the operative position so that the worker can perform work on the roof or top surface of the vehicle below the work platform, performing work operations on the roof or top surface of the vehicle from a position atop the work surface by accessing the roof or top surface of the vehicle through the access section, and transferring materials and articles between said work platform and the roof or top surface of the vehicle by passing the materials and articles through the transfer space through or adjacent the work surface, wherein the work platform further includes cushion means located beneath the work platform, the method including the step of positioning the work platform so that the cushion means engages against the roof or top surface of the vehicle and provides a cushioning between the work platform and the roof or top surface of the vehicle but without all of the weight of the work platform bearing on the roof or top surface of the vehicle through the cushion means.

8. A method as claimed in claim 7 wherein the cushion means comprises at least one flexible and gas filled cushioning compartment or bag located beneath the work platform so as to be interposed between the work platform and the roof or top surface of the vehicle.

9. A method as claimed in claim 8 wherein the vehicle comprises an aircraft fuselage having a longitudinal dimension extending in the direction from nose to tail of the aircraft, and wherein the cushion means of the work platform comprises at least two elongated gas filled cushions extending in the longitudinal direction of the fuselage so as to bear against the upper surface of the fuselage along laterally spaced lines when the work platform is located in its operative position for enabling performance of the work operations.

* * * * *